US009441334B1

(12) United States Patent
Frelich et al.

(10) Patent No.: US 9,441,334 B1
(45) Date of Patent: Sep. 13, 2016

(54) TOWPOINT SPEED CONTROL FOR A PAVING MACHINE

(71) Applicant: Caterpillar Paving Products Inc., Brooklyn Park, MN (US)

(72) Inventors: Toby Frelich, Saint Michael, MN (US); Mathew Hedrington, Ham Lake, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 14/819,118

(22) Filed: Aug. 5, 2015

(51) Int. Cl.

| | |
|---|---|
| ***E01C 21/00*** | (2006.01) |
| ***E01C 19/30*** | (2006.01) |
| ***E01C 19/40*** | (2006.01) |
| ***E01C 19/42*** | (2006.01) |
| ***E01C 19/48*** | (2006.01) |

(52) U.S. Cl.
CPC ..... *E01C 21/00* (2013.01); *E01C 19/30* (2013.01); *E01C 19/40* (2013.01); *E01C 19/42* (2013.01); *E01C 19/4866* (2013.01)

(58) Field of Classification Search
CPC .... E01C 19/004; E01C 19/26; E01C 19/288; E01C 21/00; E01C 19/40; E01C 19/42; E01C 19/4866; E01C 19/30; G04F 3/06; G04G 13/02; G04G 13/021; G08B 21/182
See application file for complete search history.

(56) References Cited

U.S. PATENT DOCUMENTS 3,691,916 A * 9/1972 Martenson ..... E01C 19/4873 404/118
4,722,636 A * 2/1988 Brock ..... E01C 19/4873 404/118
4,925,340 A * 5/1990 Heiser ..... E01C 19/004 404/118
5,201,603 A 4/1993 Bassett et al.
5,356,238 A * 10/1994 Musil ..... E01C 19/008 404/101
5,549,412 A * 8/1996 Malone ..... E01C 19/004 404/84.1
6,027,282 A * 2/2000 Horn ..... E01C 19/48 404/75
6,236,923 B1 * 5/2001 Corcoran ..... B60C 23/00 340/442
6,749,364 B1 * 6/2004 Baker ..... E01C 19/288 404/118
8,079,776 B2 * 12/2011 Lossow ..... E01C 19/48 404/84.1
8,221,025 B2 * 7/2012 Buschmann ..... E01C 19/48 404/75
2002/0168226 A1 * 11/2002 Feucht ..... E01C 19/407 404/84.1
2003/0194273 A1 * 10/2003 Lloyd ..... E01C 23/065 404/83
2005/0053447 A1 * 3/2005 Bucher ..... E01C 19/004 411/470
2009/0142133 A1 * 6/2009 Glee ..... E01C 19/004 404/75
2009/0223358 A1 * 9/2009 Green ..... F15B 19/002 91/361
2009/0317186 A1 * 12/2009 Glee ..... E01C 19/004 404/75
2011/0255918 A1 * 10/2011 Worsley ..... E01C 19/006 404/84.1
2014/0119826 A1 * 5/2014 Graham ..... E01C 19/42 404/75
2014/0186115 A1 7/2014 Graham et al.
2014/0260751 A1 9/2014 Graham et al.
2015/0063907 A1 3/2015 Graham et al.

* cited by examiner

*Primary Examiner* — Abigail A Risic
(74) *Attorney, Agent, or Firm* — Miller, Matthias & Hull LLP

(57) ABSTRACT

A controller receives inputs from a user interface that sets a speed for moving a tow point of an asphalt paving machine at a speed higher than a normal operating speed. The controller also receives signals from a user interface that moves the tow point in a selected direction at the set speed.

19 Claims, 6 Drawing Sheets

TOWPOINT SPEED CONTROL FOR A PAVING MACHINE

TECHNICAL FIELD

The present disclosure is generally directed to a paving machine and, more particularly, to selective control of a tow point for a screed of a paving machine.

BACKGROUND

"Floating screed" asphalt finishing machines, or pavers, have provided an efficient and economical method of coating an old or new roadway with a compacted layer of asphalt aggregate for many years. Floating screed pavers are generally known to those skilled in the art, as reflected by the disclosure contained in U.K. Patent 1,054,151 to the Blaw-Knox Company. Such a paver typically comprises a self-propelled traction unit, or tractor, having a hopper at its front end for receiving paving material, such as asphalt aggregate, from a dump truck. A conveyor system on the machine transfers the paving material from the hopper rearwardly for distribution in front of a floating screed. Transversely arranged screw augers positioned at the rear end of the traction unit assist in moving the paving material in a lateral direction with respect to the direction of movement of the paver, so that a relatively uniform volume of paving material is distributed across the portion of the roadbed in front of the floating screed.

The screed is commonly operated so as to "float" by virtue of being connected to the forwardly moving machine by means of pivoted leveling arms or tow arms. With forward movement, the screed physically levels any paving material lying higher than a predetermined height above the roadway surface, leaving a generally uniform thickness of such material. This function is enhanced by inclining the bottom surface of the screed so that its forward edge is higher than its rear edge, thereby providing a smaller area between the screed and the roadway and a large dragging surface at the rear of the screed. The angle defined between the bottom surface of the screed and the roadway surface is called the "angle of attack." The screed also compacts the dragged paving material in order to provide a uniform, smooth, durable pavement surface. The screed is often mounted to vibrate against the pavement material to assist in spreading and compacting the material.

The leveling arms of the screed are attached to the paver traction unit at a "tow point." In early pavers this point was a simple fixed pin connection. As a result, the thickness of the resulting paved mat could only be controlled by means of altering the screed angle of attack. Later paver designs allowed the tow point to be moved vertically using a tow point adjuster, causing a corresponding movement in the leveling arms and screed. This arrangement accommodated changes in the grade of the road surface by automatically fine tuning the initial setting of the screed angle of attack, thereby controlling the pavement mat thickness.

The screed has numerous controls that affect the temperature of the heater, the thickness of the mat, the shape of the edges, contours, etc. In an automatic mode, sensors are used to automatically adjust the screed for some or all of these settings. However, in a manual mode, an operator can control these aspects of the screed.

When in the manual state, there is no grade or slope automation system in use. Instead, an operator manually adjusts the tow point of the screed to create the desired mat profile. In order to have precise control, the tow point adjustment moves relatively slowly. That is, movement of the tow point operates at a fixed, slow rate either up or down to give the operator fine control of the mat profile. However, when creating an obstacle, such as a speed bump, or preparing the machine for transport, the fixed, slow speed can cause delays.

With respect to paving machine controls, U.S. Publication 2014/0186115 (the '115 publication) discloses linking different controls so that, for example, a change in screed height automatically increases auger height. The '115 publication fails to address problems related to the slow tow point adjustment speed in manual operation mode.

SUMMARY OF THE DISCLOSURE

In an aspect of the disclosure, a tow point adjustment system for a screed of an asphalt paving machine includes a first user interface that receives a selection of a high set point speed at or below a maximum tow point adjuster speed and above an operating speed. The system may also include a second user interface that sends a signal to alter a height of a tow point and a controller coupled to the first user interface and the second user interface. The controller may be configured to receive the signal from the second user interface and alter the height of the tow point at one of the operating speed or the high set point speed.

In another aspect of the disclosure, a method of adjusting a height of a tow point of a screed of an asphalt paving machine includes receiving, at a controller, a signal to alter the height of the tow point, selecting, at the controller, a speed for adjusting the height of the tow point from a plurality of predetermined speeds, and adjusting, via the controller, the height of the tow point at the selected speed.

In yet another embodiment, a method of adjusting a height of a tow point of a screed of an asphalt paving machine includes setting a high speed and a low speed for a tow point adjuster, receiving, at a controller, a signal to adjust the height of the tow point, and selecting, via the controller, one of the high speed and the low speed for the tow point adjuster. The method may conclude by setting, via the controller, the height of the tow point using the selected one of the high speed or the low speed.

These and other aspects and features will be more readily understood when reading the following detailed description when taken in conjunction with the accompanying drawings.

DETAILED DESCRIPTION

Figure 1:
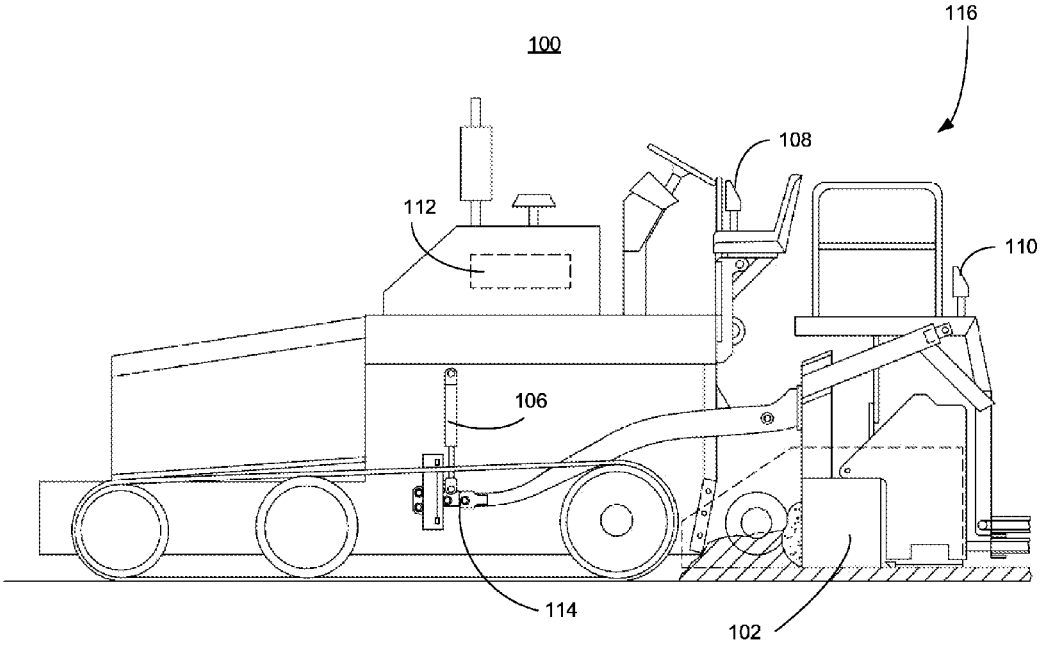
FIG. 1 is a side view of a paving machine in accordance with the current disclosure.

Referring to FIG. 1, an asphalt paving machine 100 includes a screed 102. The screed 102 forms the asphalt mat during a paving operation. As discussed above, the thickness and contour of the mat is controlled by a tow point adjuster 106 that raises and lowers a tow point 114 coupled to the screed 102 to change the screed height. Control of the mat thickness and contour may be made via a user interface 108 at an operator station or a user interface 110 on the screed 102. A controller 112 may receive inputs from one or both user interfaces 108, 110 and develop the proper outputs for operating the tow point adjuster 106. The user interfaces 108, 110 may also allow adjustment of paving machine speed, asphalt temperatures, and other screed settings as well as including condition indicators and warnings, such as oil pressure, fuel levels, etc. A tow point adjustment system 116 includes one or both of the user interfaces 108, 110, the controller 112, and the tow point adjuster 106.

In manual operation, the tow point adjuster 106 may be controlled by an operator. As discussed above, it may be desirable for the tow point adjuster 106 to move fairly slowly so that the operator can make fine adjustments as the asphalt mat is laid down. However, when making an obstacle, such as a speed bump, or when moving the screed 102 into a transport position, the slow pace of movement of the tow point adjuster 106 may be a nuisance or even a hindrance. In an embodiment, the user interfaces 108, 110 may include additional controls that allow various settings related to speed control of the tow point adjuster 106.

Figure 2:
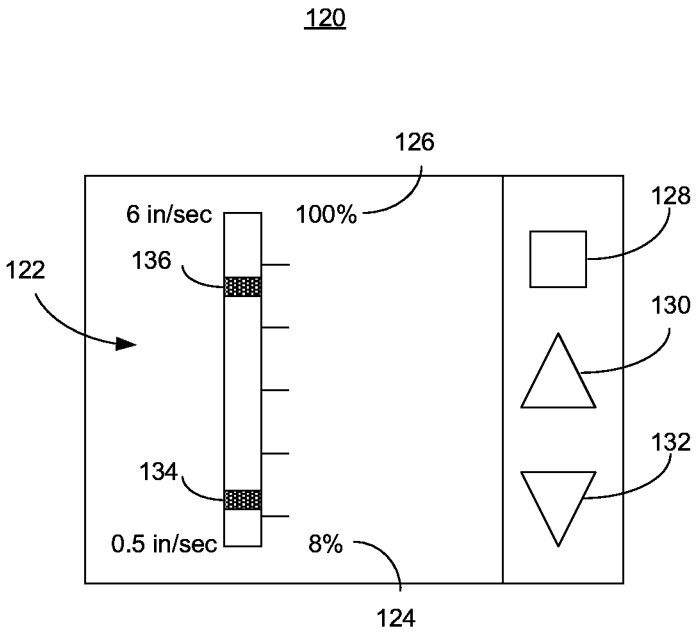
FIG. 2 depicts an embodiment of a user interface for setting tow point operating and maximum speeds.
Figure 3:
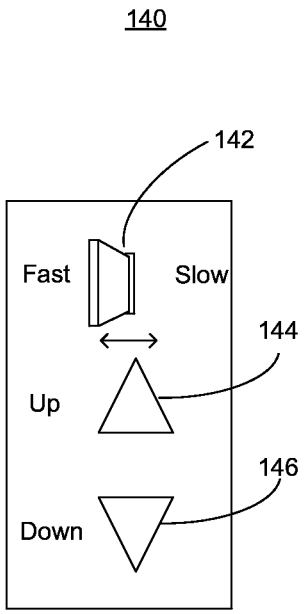
FIG. 3 depicts an embodiment of a user interface for adjusting tow point position.

One element of a tow point adjuster speed control is illustrated in FIGS. 2 and 3. A first user interface element 120 is used to set the speed at which the towpoint will operate when activated by another control, shown in FIG. 3. The first user interface element 120 may be part of an overall user interface 108, 110. The first user interface element 120 may include a set point indicator 122. The set point indicator 122 illustrates a tow point speed range setting ranging from a minimum speed 124 to a maximum speed 126 and current settings for high and low operating speeds 136 and 134, respectively. That is, the slowest possible speed is 0.5 inches per second, or 8% of the maximum speed of 6 inches per second. The actual speed at which the tow point 114 will move is shown by indicators 134 and 136, depending on which speed is selected, as described below with respect to FIG. 3.

A selector 128 allows setting either the low set point speed 134 or the high set point speed 136 by successively pressing the selector 128. Once either set point 134 or 136 is selected, an increase button 130 and a decrease button 132 may be used to move the selected set point to the desired setting. The low set point speed 134 may set at or above the minimum speed 124. The high set point speed 136 may be set at or below the maximum speed 126 and above the low set point speed 134. In operation, the user interface described below with respect to FIG. 3 may be used to determine which of the two set point speeds 134 or 136 will be used when moving the tow point 114. In alternative embodiments, only the high set point speed may be set while the low set point speed is defaulted to a normal or preset operating speed.

FIG. 3 illustrates a second user interface element in the form of a control 140 that allows an operator to select using speed selector switch 142 between the fast speed 136 and slow speed 134 that were designated as described above with respect to FIG. 2. With the switch 142 in either position, activation of either the up button 144 or the down button 146 will cause the tow point adjuster 106, and therefore the tow point 114, to move in the selected direction at the designated high speed 136 or low speed 134.

Figure 4:
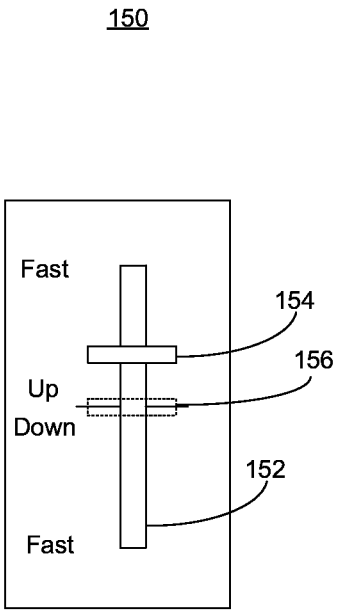
FIG. 4 depicts another embodiment of a user interface for adjusting tow point position.
Figure 5:
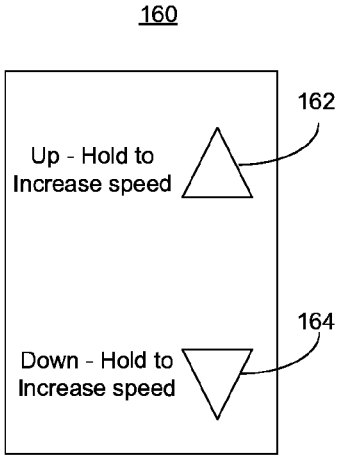
FIG. 5 depicts yet another embodiment of a user interface for adjusting tow point position.

FIGS. 4 and 5 illustrate other embodiments of a second user interface component of tow point adjuster operation. These embodiments of the second user interface may incorporate a speed setting adjustment as discussed below. Like the first user interface element 120, these second user interface components may be part of an overall user interface 108, 110.

A proportional control 150 is illustrated in FIG. 4. The proportional control 150 allows the operator to move the tow point adjuster 106 up or down based on the direction of the slider 154 on the track 152. The more the slider 154 is moved from the neutral position 156, the faster the tow point adjuster 106 will move at a variable speed according to a proportional control signal sent to the controller 112. In an embodiment, a minimum and a maximum speed of the tow point adjuster 106 may correspond to the settings made using the first user interface element 120 as discussed above with respect to FIG. 2. In another embodiment, because of the level of control available to the operator, the full range of tow point adjuster speed may be available to the operator.

Figure 6:
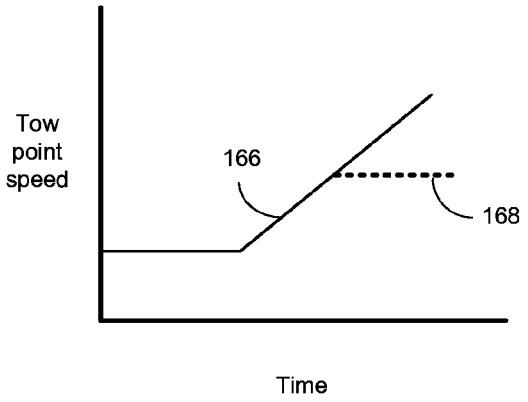
FIG. 6 is an exemplary function for setting tow point adjuster speed.

Another control 160 for moving the tow point adjuster 106 is shown in FIG. 5. In this embodiment, the control 160 has an up button 162 and a down button 164. In this embodiment, holding either button 162 and 164 will move the tow point adjuster 106 up or down, respectively. In contrast to the embodiment of FIG. 3, continued depression of either button 162 or 164 will cause the tow point speed to increase. In an embodiment, holding either button 162, 164 may cause the tow point adjuster 106 to operate at a first speed for a period of time and then increase at a fixed rate. FIG. 6 illustrates one function 166 that describes such operation. After a button 162 or 164 is initially activated, the speed of the adjuster 106 is constant at a slow speed for a period of time and then increases at a constant rate. In one embodiment, the increase stops at a high set point speed 168 according to the setting made using the first user interface element 120.

Figure 7:
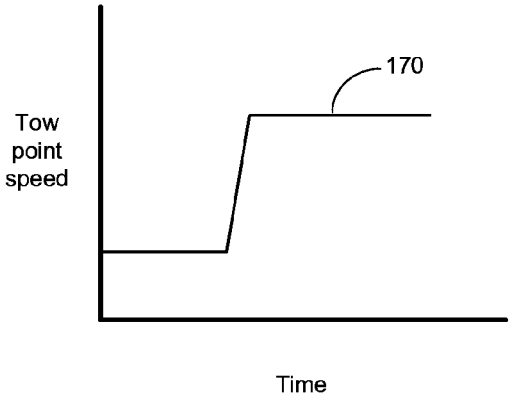
FIG. 7 is another exemplary function for setting tow point adjuster speed.

FIG. 7 illustrates another function 170 for describing operation during continued activation of one button 162 or 164. In this embodiment, the tow point speed remains at the low setting and transitions to the high speed after a predetermined time period according to the settings made via the first user interface element 120. For example, an operator may find it more convenient to have the speed transition to the higher speed setting immediately rather than waiting for it ramp up as in the embodiment illustrated in FIG. 6. It will be apparent to one of skill in the art that similar predetermined functions can be used to translate switch operation to tow point movement and tow point adjuster speed.

Figure 8:
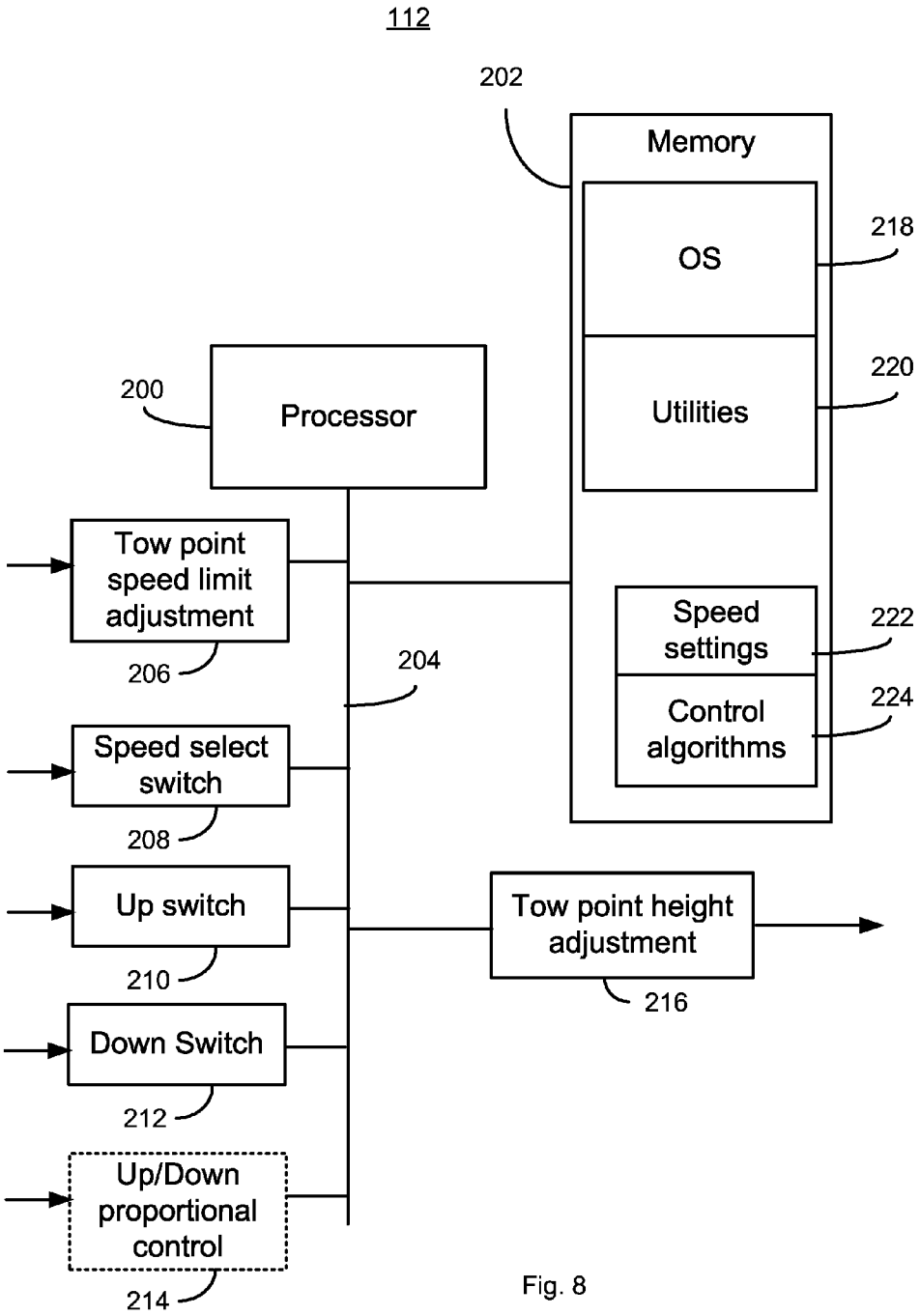
FIG. 8 is a block diagram of a controller in accordance with the current disclosure.

A block diagram of a controller 112 is depicted in FIG. 8. The controller 112 includes a processor 200 and a memory 202 coupled by a data bus 204. The memory 202 may be any of a number of physical memory devices, including but not limited to, RAM, ROM, flash memory, EEPROM but not including carrier waves or propagated media.

Also connected to the data bus 204 may be input devices coupled to external sensors and user interfaces. A first input 206 may be coupled to a first user interface element 120. Another input 208 may be coupled to a speed selector switch 142 allowing selection between fast and slow speeds, while additional inputs 210 and 212 may be coupled to up button 144 and down button 146, respectively.

In embodiments so equipped, another input 214 may be coupled to a proportional input device such as proportional control 150. In an embodiment, the input 214 may have an analog input capable of processing either a current signal or an analog voltage signal. In an embodiment, all user interface elements may be coupled to the controller via a single user interface device, such as a touch screen display (not depicted).

An output 216 may drive the tow point adjuster 106. In various embodiments, the output 216 may control a hydraulic valve or an electric motor drive.

The memory 202 may contain programs and settings that cause the processor 200 to perform various functions. The memory 202 may include an operating system 218 supporting core functions of the controller 112 as well as utilities 220 that may include calibration and diagnostic functions. Speed settings 222 may include data related to minimum and maximum tow point adjuster speeds, low and high set point speeds, and transfer functions such as those discussed above with respect to FIGS. 6 and 7. Control algorithms 224 may be used to monitor inputs 206, 208, 210, 212, 214 and generate the appropriate signals at output 216. In various embodiments, the controller 112 may be a separate device or its functions may be incorporated into an existing machine controller (not depicted).

INDUSTRIAL APPLICABILITY

In general, the present disclosure can find industrial applicability in a number of different settings. For example, the present disclosure may be employed in both wheel and track-based asphalt paving machines. Such machines may be used in a variety of applications, such as, but not limited to those used in the construction industry.

Figure 9:
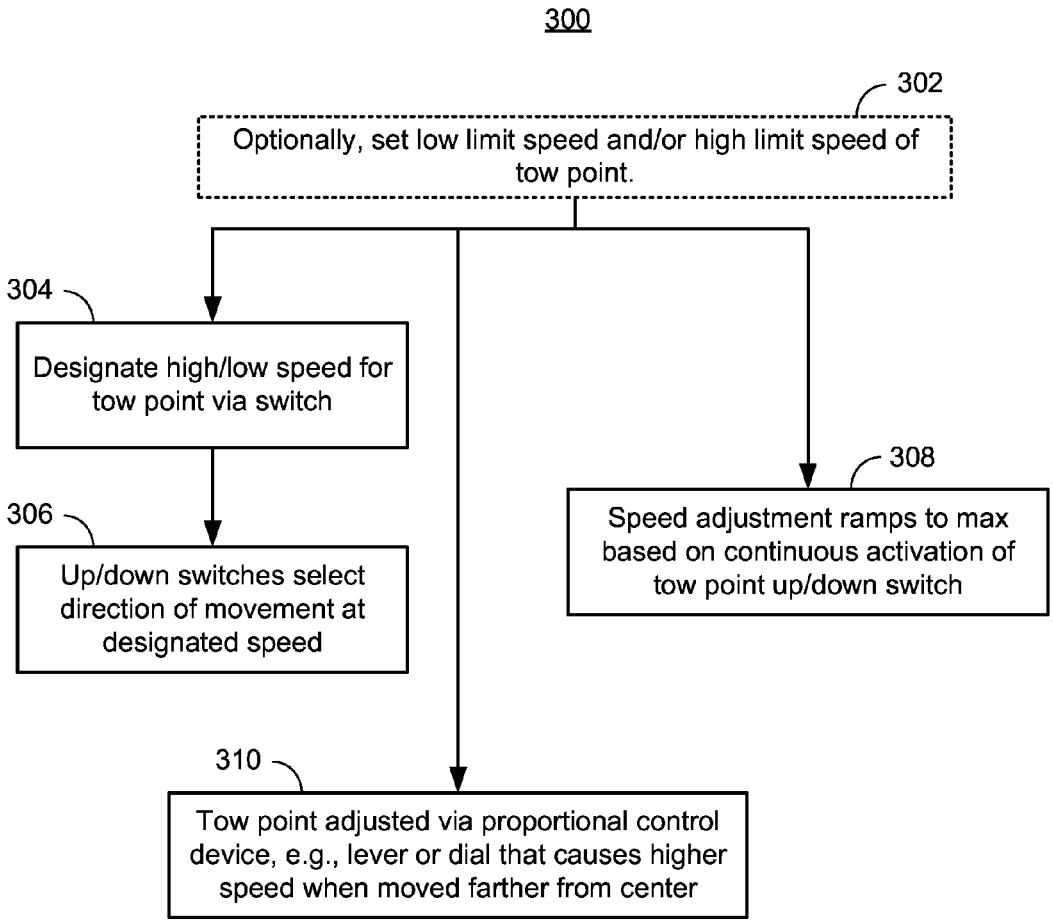
FIG. 9 is a flowchart illustrating an exemplary method of adjusting a height of a tow point of a screed of an asphalt paving machine.

A flowchart of a method 300 of adjusting a height of a tow point 114 of a screed 102 of an asphalt paving machine 100 is illustrated at FIG. 9. At block 302, a low set point speed 134 and/or a high set point speed 136 may be set by an operator or technician. The low set point speed 134 establishes the slow speed for operating the tow point adjuster 106, that is, a normal operating speed. The high set point speed 136 establishes a limit high speed for the tow point adjuster 106. The high set point speed 136 is any value up to a maximum speed of the tow point adjuster 106. In an embodiment, these values may be set prior at a time of operation of the paving machine 100. In another embodiment, the values may be predetermined at a shop or maintenance facility. When block 302 is not used, the low set point speed 134 may default to a standard speed familiar to operators of the particular type of equipment. Similarly, when block 302 is not used, the high set point speed 136 may be set to the maximum available speed of the tow point adjuster 106.

In one embodiment, the method 300 may continue at block 304 where a speed for the tow point adjuster 106 is selected using a switch 142. At block 306, either button 144 or button 146 may be selected to raise or lower the tow point 114 at the speed selected at block 304.

In another embodiment, the method 300 may follow from block 302, if used, to block 308 to implement speed control based on selection of an up button 162 or down button 164 as illustrated in FIG. 5. As discussed above, continued selection of either button 162 or 164 may cause the speed of the tow point adjuster 106 to increase based on the duration of the button activation. In one embodiment, shown by function 166 in FIG. 6, the speed may remain at a slow rate for a predetermined time and then increase at a constant rate to either a maximum speed or the predetermined high set point speed 168. In another embodiment, shown by function 170 in FIG. 7, the tow point adjuster speed may remain at the low value for a period of time and transition to the high speed.

In yet another embodiment of method 300, execution follows block 302, if used, at block 310 so that the tow point adjuster 106 is moved at a speed proportional to a distance of a lever or slider 154 from a neutral position 156. That is, the farther the slider 154 is moved away from the neutral position, the faster the tow point 114 is moved by the tow point adjuster 106. The speed may cap at either the high set point speed 168 or at the maximum possible speed, based on a configuration of the machine 100.

The ability to change the speed of the tow point adjuster 106 benefits owners and operators of paving machines for several reasons. Paving operations may be completed more quickly for paving operations such as formation of speed bumps. Similarly, preparing the paving machine 100 for transport may be accomplished more quickly, saving time and money. Operators benefit from the ability to change the tow point adjuster speed simply because an operator is simply able to reduce the time spent waiting for these operations to complete.

While the above discussion has been directed to a particular type of vehicle, the techniques described above have application to many other machines.

What is claimed is:

1. A tow point adjustment system for a screed of an asphalt paving machine comprising:

a first user interface that receives a selection of a high set point speed for a tow point adjuster speed that is above a preset operating speed;

a second user interface that sends a signal to alter a height of a tow point; and a controller coupled to the first user interface and the second user interface, the controller configured to receive the signal from the second user interface and alter the height of the tow point at the high set point speed.

2. The tow point adjustment system of claim 1, wherein the second user interface comprises a speed selection switch, an up button, and a down button.

3. The tow point adjustment system of claim 2, wherein the speed selection switch selects between the operating speed and the high set point speed.

4. The tow point adjustment system of claim 1, wherein the second user interface comprises an up button and a down button, wherein the controller increases the tow point adjuster speed according to a predetermined function upon continuous activation of one of the up button or the down button.

5. The tow point adjustment system of claim 1, wherein the second user interface comprises a proportional control that continuously increases a speed of the tow point as the proportional control is moved farther from a neutral position.

6. The tow point adjustment system of claim 1, wherein the second user interface is located at an operator station of the asphalt paving machine.

7. The tow point adjustment system of claim 1, wherein the second user interface is located at the screed.

8. A method of adjusting a height of a tow point of a screed of an asphalt paving machine, the method comprising:

receiving, at a controller, a signal to alter the height of the towpoint;

selecting, at the controller, a speed for adjusting the height of the towpoint;

adjusting, via the controller, the height of the tow point at the selected speed; and receiving, at the controller, a second signal that sets a high set point speed, the high set point speed at or below a maximum tow point adjuster speed.

9. The method of claim 8, wherein the selected speed is the high set point speed.

10. The method of claim 8, wherein receiving the signal to alter the height of the tow point comprises receiving a proportional control signal that changes magnitude according to an input at a user interface.

11. The method of claim 8, wherein receiving the signal to alter the height of the tow point comprises receiving the signal having an indication of a first speed or a second speed for use in selecting the speed and a second indication of a direction for adjusting the height of the tow point.

12. The method of claim 8, wherein receiving the signal to alter the height of the tow point comprises monitoring the signal for a duration of a direction button activation, wherein selecting the speed for an adjustment of the height of the tow point is a function of the duration.

13. A method of operating a paving machine, the method comprising:

setting a low set point speed and a high set point speed for adjusting a height of a tow point adjuster;

receiving, at a controller, a signal to adjust the height of the tow point;

selecting, via the controller, one of the low set point speed and the high set point speed for the tow point adjuster; and setting, via the controller, the height of the tow point using the selected one of the low or the high set point speeds.

14. The method of claim 13, wherein setting the high set point speed for the tow point adjuster comprises setting the high set point speed below a maximum speed for the tow point adjuster.

15. The method of claim 13, wherein setting the low set point speed comprises setting the low set point speed above a minimum speed for the tow point adjuster.

16. The method of claim 13, wherein receiving, at the controller, the signal to adjust the height of the tow point comprises receiving a selection of an up button and a down button and an indication of one of the high set point speed and the low set point speed, wherein the controller uses the signal for selecting the one of the high set point speed and the low set point speed when adjusting the height of the tow point.

17. The method of claim 13, wherein receiving, at the controller, the signal to adjust the height of the tow point comprises monitoring a duration of activation of one of an up button or a down button, wherein the tow point adjuster is operated at a first speed for a first duration and a second speed after the first duration.

18. The method of claim 13, wherein receiving, at the controller, the signal to adjust the height of the tow point comprises receiving a proportional control signal, wherein the tow point adjuster is operated a variable speed corresponding to a value of the proportional control signal.

19. The method of claim 18, wherein the variable speed ranges between the low set point speed and the high set point speed.

* * * * *